US008991964B2

(12) United States Patent
Usuda et al.

(10) Patent No.: US 8,991,964 B2
(45) Date of Patent: Mar. 31, 2015

(54) RECORDING APPARATUS WITH A RADIATING UNIT FOR CURING INK

(75) Inventors: Hidenori Usuda, Matsumoto (JP); Shinichi Kamoshida, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 169 days.

(21) Appl. No.: 13/346,277

(22) Filed: Jan. 9, 2012

(65) Prior Publication Data

US 2012/0176436 A1 Jul. 12, 2012

(30) Foreign Application Priority Data

Jan. 11, 2011 (JP) ..... 2011-003101

(51) Int. Cl.
*B41J 29/38* (2006.01)
*B41J 11/00* (2006.01)
*B41J 2/21* (2006.01)

(52) U.S. Cl.
CPC ..... *B41J 11/002* (2013.01); *B41J 2/2107* (2013.01)
USPC ..... 347/16

(58) Field of Classification Search
None
See application file for complete search history.

(56) References Cited

U.S. PATENT DOCUMENTS

| | | | | |
|---|---|---|---|---|
| 6,783,227 | B2 | 8/2004 | Suzuki et al. | |
| 7,393,095 | B2 | 7/2008 | Oshima et al. | |
| 2006/0203024 | A1* | 9/2006 | Kusunoki | 347/15 |
| 2007/0165091 | A1 | 7/2007 | Oishi | |
| 2009/0135239 | A1* | 5/2009 | Chretien et al. | 347/102 |
| 2009/0167794 | A1* | 7/2009 | Hosono et al. | 347/6 |
| 2009/0244126 | A1* | 10/2009 | Okamori | 347/9 |
| 2010/0238245 | A1* | 9/2010 | Ushiyama | 347/102 |
| 2011/0096132 | A1* | 4/2011 | Kobayashi et al. | 347/102 |

FOREIGN PATENT DOCUMENTS

| | | |
|---|---|---|
| JP | 2004-314304 | 11/2004 |
| JP | 2005-104108 | 4/2005 |
| JP | 2007-190770 | 8/2007 |
| JP | 2010-030165 | 2/2010 |
| JP | 2010-155385 | 7/2010 |

* cited by examiner

*Primary Examiner* — Geoffrey Mruk
*Assistant Examiner* — Bradley Thies
(74) *Attorney, Agent, or Firm* — Workman Nydegger

(57) ABSTRACT

A recording apparatus includes: a recording head that discharges ink onto a recording target medium from a nozzle; a first moving unit that moves at least one of the recording target medium and the recording head; a first radiating unit that is disposed at the opposite side to the recording head with respect to the recording target medium and radiates electromagnetic waves that cure the ink; and a second moving unit that moves at least one of the recording target medium and the first radiating unit, and a control unit that controls driving of the recording head, the first moving unit, the first radiating unit, and the second moving unit.

14 Claims, 7 Drawing Sheets

RECORDING APPARATUS WITH A RADIATING UNIT FOR CURING INK

BACKGROUND

This application claims priority to Japanese Patent Application No. 2011-003101, filed Jan. 11, 2011 which is expressly incorporated herein by reference.

1. Technical Field

The present invention relates to a recording apparatus that discharges ink from a recording head and radiates electromagnetic waves to the ink placed on a recording target medium such that the ink is cured by chemical reaction.

It is assumed herein that the recording apparatus includes an ink jet printer, a line printer, a copy machine, a fax machine, and the like.

2. Related Art

In the related art, as described in JP-A-2005-104108 and JP-A-2004-314304, an ink jet printer includes a recording head and an ultraviolet radiating section disposed around the recording head. In the components, the recording head includes a nozzle that discharges ultraviolet curable ink onto a paper sheet.

The ultraviolet radiating section is disposed at the same side as the recording head with respect to the paper sheet.

FIG. 7 is a front cross-sectional view showing the relationship between a recording head 41 and an ultraviolet radiating section 43 in the related art.

As shown in FIG. 7, a printer 40 of the related art includes the recording head 41 and the ultraviolet radiating section 43. In the components, the recording head 41 is disposed to discharge ultraviolet curable ink 45 from a nozzle 42 onto a paper sheet 46 supported on a medium supporting section 47. Further, the ultraviolet radiating section 43 is disposed close to both sides in the movement direction of the recording head 41. Further, the ultraviolet radiating section 43 can integrally move with the recording head 41. When the recording head 41 moves while discharging ink 45, the ultraviolet radiating section 43 at the rear side in the traveling direction cures the ink 45 by radiating ultraviolet rays 44 onto the position where the ink 45 lands on the paper sheet 46.

However, since the ultraviolet radiating section 43 is disposed close to the recording head 41, some of the radiated ultraviolet rays 44 reflects from the surface of the ink 45 and the reflecting ultraviolet rays 44 may hit the nozzle 42 of the recording head 41. In this case, the nozzle 42 may be clogged by curing of the ultraviolet curable ink 45 in the nozzle 42. Further, although JP-A-2004-314304 proposes a configuration of disposing a guard between a recording head and an ultraviolet radiating section such that reflected ultraviolet rays are blocked by the guard, the surface of the ink is not necessarily flat, such that the reflecting ultraviolet rays undergo diffusion reflection. Therefore, it is not sufficient to just dispose the guard.

SUMMARY

An advantage of some aspects of the invention is to provide a recording apparatus implemented in consideration of the problems that are generated when curing ink landed on a recording target medium by radiating electromagnetic waves onto the ink.

According to a first aspect of the invention, there is provided a recording apparatus including: a recording head that discharges ink onto a recording target medium from a nozzle; a first moving unit that moves at least one of the recording target medium and the recording head; a first radiating unit that is disposed at the opposite side to the recording head with respect to the recording target medium and radiates electromagnetic waves that cure the ink; and a second moving unit that moves at least one of the recording target medium and the first radiating unit, and a control unit that controls driving of the recording head, the first moving unit, the first radiating unit, and the second moving unit, wherein when the nozzle of the recording head is not opposite to the position where the ink discharged from the nozzle of the recording head is landed on the recording target medium, the control unit controls the first radiating unit to radiate electromagnetic waves to the position where the ink is landed.

Light curable ink may be exemplified as the ink that is cured by a chemical reaction generated by electromagnetic waves. The "light curable ink" is ink that is cured (solidified) by receiving radiated light. The light includes ultraviolet rays, visible light, and infrared rays. For example, there is ultraviolet cure (solidifying) ink (UV ink) that is cured by receiving radiated ultraviolet rays. A change in capacity (volume) during curing (solidifying) is small in comparison to dye ink or pigment ink which is cured by volatilization (solidification) of the solvent of the ink. As the technical idea, it is preferable that the curing (solidifying) be achieved by a chemical reaction of components, such as resin, in the ink by energy supplied from electromagnetic waves. The ink is not limited to the ink that is cured (solidified) by ultraviolet rays.

Further, the fact that the "recording target medium has transparency that transmits the electromagnetic waves" implies that the recording target medium has a property of transmitting even a small amount of electromagnetic waves. When the side with the ink landed is the front, it is preferable that the ink can be cured by irradiating from the back. In general, the transparent recording target medium has the transparency as long as a specific treatment is not applied. Further, the transparent recording target medium is not limitative and an opaque recording target medium may have the transparency.

In this aspect, when the position and the nozzle are not opposite to each other, the first radiating unit may irradiate the position with the ink laded on the recording target medium from the opposite side. Therefore, the electromagnetic waves are not radiated to the nozzle of the recording head. As a result, the ink is not cured in the nozzle.

Further, since the recording target medium has transparency, it is possible to cure the ink on the front by radiating electromagnetic waves to the ink on the front from the back (the opposite side).

For example, when the recording target medium is a semitransparent medium, such as thin paper, a complete achromatic transparent film, or a transparent chromatic film, which has transparency, it is possible to cure the ink by radiating ultraviolet rays to the ink from the opposite side. Therefore, this configuration is greatly effective in this case. Further, even for a semitransparent medium or a non-transparent medium, it is possible to achieve the same operational effect, even if the medium can transmit a predetermined level of electromagnetic waves.

Further, the recording target medium function as a barrier that prevents ink droplets and ink mist from sticking to the first radiating unit. As a result, the first radiating unit is not stained.

According to a second aspect of the invention, in the recording apparatus according to a first aspect, when the first radiating unit radiates the electromagnetic waves, the control unit may relatively move the first radiating unit and the recording target medium by using the first moving unit, and the radiation amount of the electromagnetic waves radiated from the first radiating unit may be changed in accordance with the amount of landed ink per unit area at the positions where the electromagnetic waves are radiated, onto the recorded data.

According to this aspect, in addition to the same operational effect as the first configuration, the radiation amount is changed in accordance with the amount of the landed ink per unit area while the first radiating unit and the recording target medium is relatively moved at a constant speed. Therefore, it is possible to radiate the electromagnetic waves that are necessary to cure the ink at the position, as energy. As a result, it is possible to equally cure the ink at the position where the amount of landed ink per unit are is large and small, such that curing non-uniformity is not caused.

Further, energy is also saved because it is possible to prevent an unnecessarily large amount of electromagnetic waves from being radiated to the positions where the amount of landed ink per unit area is small.

Further, it is possible to prevent an increase in the amount of contraction of the ink, which is an example of a defect due to radiation of an unnecessarily large amount of electromagnetic waves.

According to a third aspect of the invention, in the recording apparatus according to the second aspect, the control unit may decrease the radiation amount when the landed amount is relatively decreased as the first radiating unit and the recording target medium relatively move, and may increase the radiation amount when the landed amount is relatively increased.

According to this aspect, in addition to the same operational effect as the first aspect, the relative speed of the first radiating unit and the recording target medium is changed in accordance with the amount of landed ink per unit area, with the radiation amount maintained at a predetermined amount. Therefore, it is possible to radiate the electromagnetic waves that are necessary to cure the ink at the position, as energy. As a result, it is possible to achieve the same effect as the second aspect.

According to a fourth aspect of the invention, in the recording apparatus according to the first aspect, when the first radiating unit radiates the electromagnetic waves, the control unit may relatively move the first radiating unit and the recording target medium by using the first moving unit, and a relatively moving speed between the first radiating unit and the recording target medium may be changed in accordance with the amount of landed ink per unit area at the positions where the electromagnetic waves are radiated, onto the recorded data.

According to this aspect, in addition to the same operational effect as those of any one of the first to third aspects, it is possible to completely cure the ink by radiating electromagnetic waves from the opposite side after temporarily curing (pinning) the ink by radiating electromagnetic waves from the same side. For example, when ink is repeatedly discharge onto ink that has been landed, fixation of the surface of the landed ink is better in half-drying by temporary curing (pinning) (non-completely cured state) and complete drying (completely cured state), such that the configuration is effective in this case.

Further, in this case, since the ink is repeatedly discharged thereon, the electromagnetic waves from the second radiating unit may not reach the lower ink, such that the lower ink may not be completely cured by the electromagnetic waves from the second radiating unit. In this case, there is only the first radiating unit that allows electromagnetic waves to surely reach the lower ink, such that it may be efficient to cure the lower ink with the electromagnetic waves from the first radiating unit.

According to a fifth aspect of the invention, in the recording apparatus according to the fourth aspect, the second moving unit may increase the relatively moving speed when the landed amount is relatively decreased as the first radiating unit and the recording target medium relatively move, and may decrease the relatively moving speed when the landed amount is relatively increased.

According to this aspect, in addition to the same operational effect as that of the fourth aspect, it is particularly effective in the recording mode to include the first radiating unit and the second radiating unit. That is, as described above, it is possible to improve fixation of the second type of ink.

Further, it is possible to completely cure the first type of ink with the first radiating unit after the second type of ink is landed.

According to a sixth aspect of the invention, the recording apparatus according to the first aspect may further includes a second radiating unit that is disposed at the same side as the recording head with respect to the recording target medium, radiates electromagnetic waves that cure the ink, and is controlled to be driven by the control unit, wherein the control unit may control the first radiating unit to radiate the electromagnetic waves to the position with the ink landed on the recording target medium after the second radiating unit radiates the electromagnetic waves to the position with the ink landed on the recording target medium.

According to this aspect, in addition to the same operational effect as that of any one of the first to fifth aspects, it is possible to achieve uniform curing by adjusting the radiation amount to a necessary amount, even if the radiation amount of electromagnetic waves for curing is different in accordance with the type of ink.

Although the components of the ink are different in accordance with the type of the ink, for example, the black component of black ink absorbs light and radiated light is absorbed at position close to the surface of ink droplets, such that the inside far from the surface tends to be difficult to cure. Further, white ink using titanium oxide or metallic color-based ink using aluminum uses metal. Therefore, the light, such as the radiated ultraviolet rays, is reflected from position close to the surface of the ink droplets, such that the inside far from the surface tends to be difficult to cure. Uniform curing without curing non-uniformity can be achieved by adjusting the radiation amount in accordance with the types of ink in consideration of this tendency.

For example, when the side with the ink landed is the front and light, such as the ultraviolet rays, is radiated from both of the front and back with the radiation amount adjusted, it is possible to send the light to the inside without non-uniformity, as compared with when the ultraviolet rays are radiated only from one side, which is particularly efficient.

According to a seventh aspect of the invention, in the recording apparatus according to the sixth aspect, the recording head may include: a first nozzle that discharges a first type of ink to record an image on the recording target medium; and a second nozzle that discharges a second type of ink for a base, and wherein the control unit may control the first nozzle to discharge the first type of ink onto the recording target medium, control the second radiating unit to radiate the electromagnetic waves to the position with the first type of ink landed on the recording target medium, control the second nozzle to discharge the second type of ink to the position with the first type of ink landed on the recording target medium, control the second radiating unit to radiate the electromagnetic waves to the position with the second type of ink landed on the recording target medium, and controls the first radiating unit to radiate the electromagnetic waves to the position with the first type of ink landed on the recording target medium.

According to an eighth aspect of the invention, in the recording apparatus according to the sixth aspect, the recording head may include a first nozzle that discharges a first type of ink for recording an image on a the recording target medium and a second nozzle that discharges a second type of ink for a base, and the control unit may control the second recording head to discharge the second type of ink onto the recording target medium, control the second radiating unit to radiate the electromagnetic waves to the position with the second type of ink landed on the recoding target medium, control the first nozzle to discharge the first type of ink to the position with the second type of ink landed on the recording target medium, control the second radiating unit to radiate the electromagnetic waves to the position with the first type of ink landed on the recording target medium, and control the first radiating unit to radiate the electromagnetic waves to the position with the second type of ink landed on the recording target medium.

According to a ninth aspect of the invention, the recording apparatus according to the first aspect may further include: the second radiating unit that is disposed at the same side as the recording head with respect to the recording target medium, radiates electromagnetic waves that cure the ink, and is controlled to be driven by the control unit, wherein the control unit may control the second radiating unit to radiate the electromagnetic waves to the position with the ink landed on the recording target medium after the first radiating unit radiates the electromagnetic waves to the position with the ink landed on the recording target medium.

According to a tenth aspect of the invention, in the recording apparatus according to the ninth aspect, the recording head may include a first nozzle that discharges a first type of ink for recording an image on a the recording target medium and a second nozzle that discharges a second type of ink for a base, and the control unit may control the first nozzle to discharge the first type of ink onto the recording target medium, control the first radiating unit to radiate the electromagnetic waves to the position with the first type of ink landed on the recoding target medium, control the second nozzle to discharge the second type of ink to the position with the first type of ink landed on the recording target medium, control the second radiating unit to radiate the electromagnetic waves to the position with the second type of ink landed on the recording target medium, and control the first radiating unit to radiate the electromagnetic waves to the position with the first type of ink landed on the recording target medium.

According to an eleventh aspect of the invention, in the recording apparatus according to the ninth aspect, the recording head may include a first nozzle that discharges a first type of ink for recording an image on a the recording target medium and a second nozzle that discharges a second type of ink for a base, and the control unit may control the second nozzle to discharge the second type of ink onto the recording target medium, control the first radiating unit to radiate the electromagnetic waves to the position with the second type of ink landed on the recoding target medium, control the first nozzle to discharge the first type of ink to the position with the second type of ink landed on the recording target medium, control the second radiating unit to radiate the electromagnetic waves to the position with the first type of ink landed on the recording target medium, and control the first radiating unit to radiate the electromagnetic waves to the position with the second type of ink landed on the recording target medium.

According to a twelfth aspect of the invention, the recording apparatus according to the first aspect may further include: the second radiating unit that is disposed at the same side as the recording head with respect to the recording target medium, radiates electromagnetic waves that cure the ink, and is controlled to be driven by the control unit, wherein the control unit may control the first radiating unit and the second radiating unit to radiate the electromagnetic waves to the position with the ink landed on the recording target medium such that at least radiation timings are partially overlapped.

According to the thirteenth aspect of the invention, in the recording apparatus according to the twelfth aspect, the recording head may include a first nozzle that discharges a first type of ink for recording an image on a the recording target medium and a second nozzle that discharges a second type of ink for a base, and the control unit may control the first nozzle to discharge the first type of ink onto the recording target medium, control the first radiating unit and the second radiating unit to radiate the electromagnetic waves to the position with the first type of ink landed on the recording target medium such that at least the radiation timings are partially overlapped, control the second nozzle to discharge the second type of ink to the position with the first type of ink landed on the recording target medium, control the second radiating unit to radiate the electromagnetic waves to the position with the second type of ink landed on the recording target medium, and control the first radiating unit to radiate the electromagnetic waves to the position with the first type of ink landed on the recording target medium.

According to a fourteenth aspect of the invention, in the recording apparatus according to the twelfth aspect, the recording head may include a first nozzle that discharges a first type of ink for recording an image on a the recording target medium and a second nozzle that discharges a second type of ink for a base, and the control unit may control the second nozzle to discharge the second type of ink onto the recording target medium, control the first radiating unit and the second radiating unit to radiate the electromagnetic waves to the position with the second type of ink landed on the recording target medium such that at least the radiation timings are partially overlapped, control the first nozzle to discharge the first type of ink to the position with the second type of ink landed on the recording target medium, control the second radiating unit to radiate the electromagnetic waves to the position with the first type of ink landed on the recording target medium, and control the first radiating unit to radiate the electromagnetic waves to the position with the second type of ink landed on the recording target medium.

According to a fifteenth aspect of the invention, in the recording apparatus according to the first aspect, the control unit may change the amount of electromagnetic waves radiated by the first radiating unit in accordance with types of the ink.

According to a sixteenth aspect of the invention, A recording method in a recording apparatus including a recording head that discharges ink onto a recording target medium from the nozzle and a radiating unit that is disposed at the opposite side to the recording head with respect to the recording target medium and radiates electromagnetic waves that cure the ink, the method includes: discharging ink onto the recording target medium; and radiating the electromagnetic waves to a position with the ink landed, when the nozzle of the recording head is not opposite to the position where the ink discharged from the nozzle of the recording head is landed on the recording target medium.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described with reference to the drawings.

Figure 1:
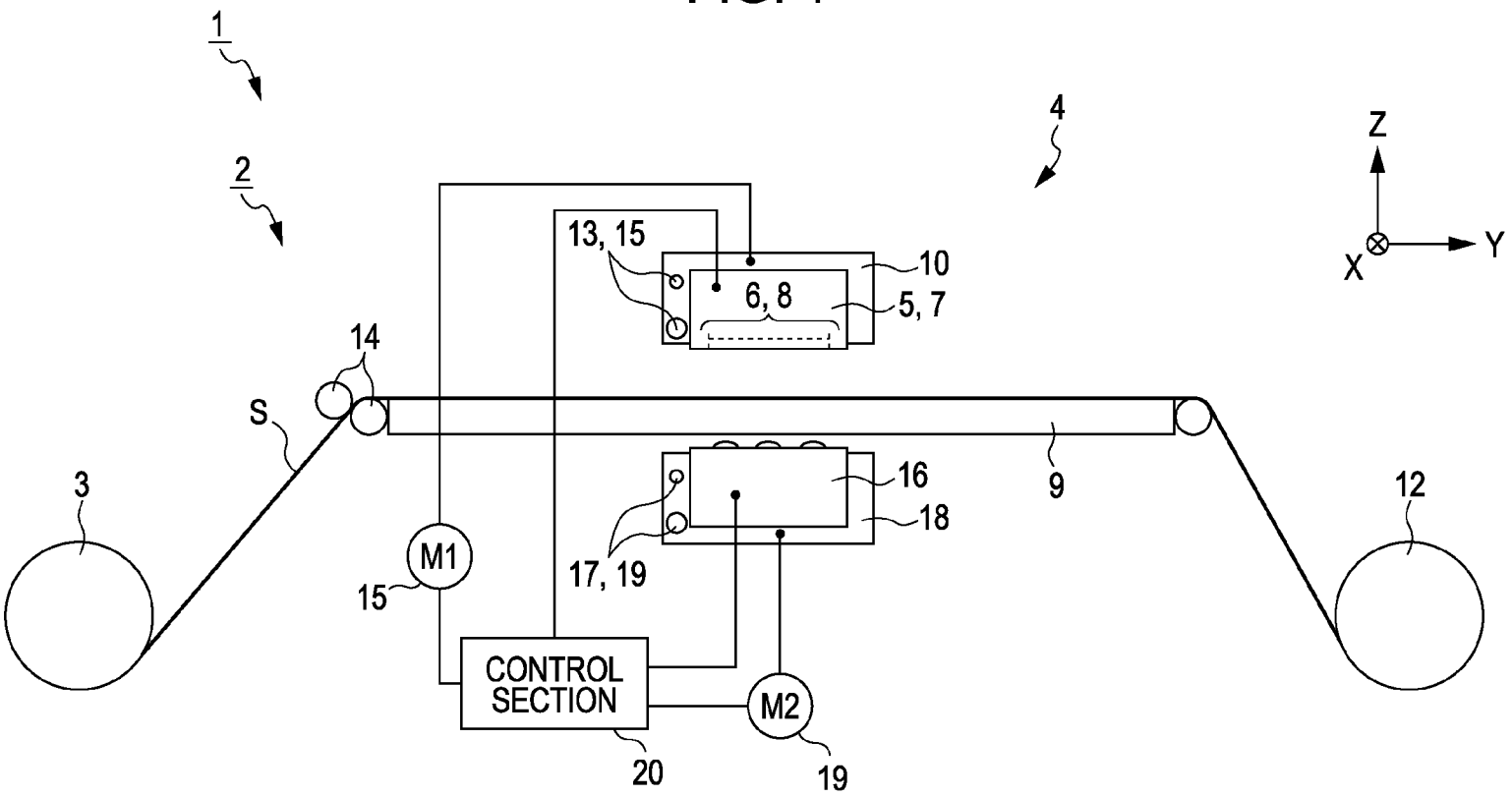
FIG. 1 is a side view schematically showing a printer according to an embodiment.

FIG. 1 is a side view schematically showing a printer 1 that is an example of a recording medium according to the invention.

As shown in FIG. 1, the printer 1 includes a medium transporting section 2, a recording section 4, and a winding unit 12 that is an example of a discharging section. The medium transporting section 2 in the components is disposed to transport a transparent film S, which is a rolled medium that is an example of a recording target medium S, to the downstream side in the transporting direction (the direction of the arrow of an Y axis). It is assumed in the embodiment that the recording target medium S has transparency that transmits ultraviolet rays W that is an example of electromagnetic waves that cure ink.

The medium transporting section 2 includes, in detail, a sending unit 3 and a pair of rollers 14. The sending unit 3 in the components is disposed to release and send out the transparent film S wound in a roll shape to the downward side in the sending direction. Further, the pair of rollers 14 is disposed to send the released transparent film S to the recording section 4 at the further downstream side.

Further, the recording section 4 is disposed to perform recording by discharging ink onto the transparent film S at a further downstream side than the medium transporting section 2.

In detail, the recording section 4 includes a first recording head 5 and a second recording head 7 that are recording heads and a medium supporting section 9 having transparency at least at a portion transmitting electromagnetic waves W described below. A first nozzle 6 that is a nozzle discharging ink is disposed on a surface opposite to the medium supporting section 9 in the first recording head 5, in the components. Similarly, a second nozzle 8 is disposed on a surface opposite to the medium supporting section 9 in the second recording head 7.

Further, the first recording head 5 and the second recording head 7 are disposed in a first carriage 10. Further, the first carriage 10 is movable to the width direction X of the transparent film S by power of a first guide shaft 13 that is a first carriage moving unit 15 and a first driving motor M1. Further, the first carriage 10 is moved by the control of a control section 20.

Further, the medium supporting section 9 is disposed to maintain the distance between the transparent film S and the first and second recording heads 5 and 7 at a predetermined distance while supporting the transparent film S. Further, the Z-axial direction is a direction where the medium supporting section 9 and the first and second recording heads 5 and 7 face each other. Further, the Z-axial direction is also the vertical direction.

A first radiating unit 16 that can radiate ultraviolet rays W, for example, an LED, which is an example of electromagnetic waves W that can cure ink, is disposed under the medium supporting section 9. The first radiating unit 16 is disposed in a second carriage 18. Further, the second carriage 18 is movable in the width direction X of the transparent film S by power of a second guide shaft 17 that is a second carriage moving unit 19 and a second driving motor M2. Further, the second carriage 18 is moved by the control of the control unit 20. Further, the medium supporting section 9 has transparency at least at a portion such that the first radiating unit 16 can radiate ultraviolet rays W to the transparent film S from under, that is, the opposite side to the recording heads 5 and 7. For example, the portion may be transparent.

The winding unit 12 is disposed to wind the transparent film S that has been recorded, at a side further downstream than the recording section 4.

Further, although the transparent film S is described as an example of the roll medium, the roll medium is not limited to the transparent film S. Obviously, fabric (cloth) or paper may be used. Further, the recording target medium S is not limited to the roll shape. A so-called single sheet of paper may be used.

Next, the first recording head 5, the second recording head 7, and the first radiating unit 16 are described in more detail.

Figure 2A:
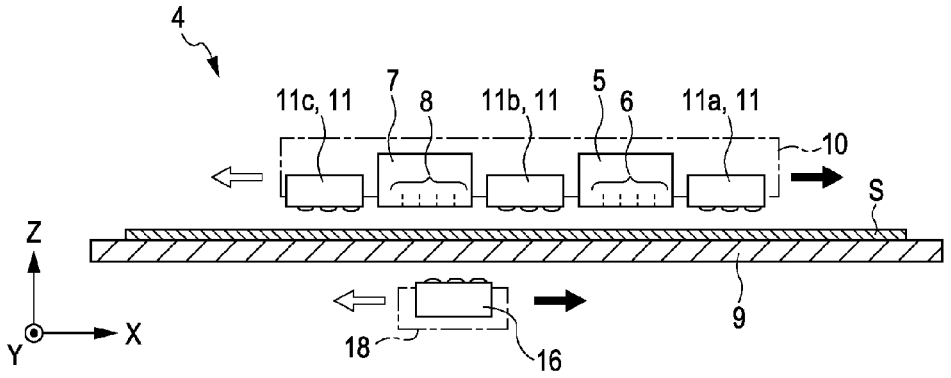
FIGS. 2A and 2B are a front cross-sectional view and a plan view schematically showing a recording section according to the embodiment, respectively.
Figure 2B:
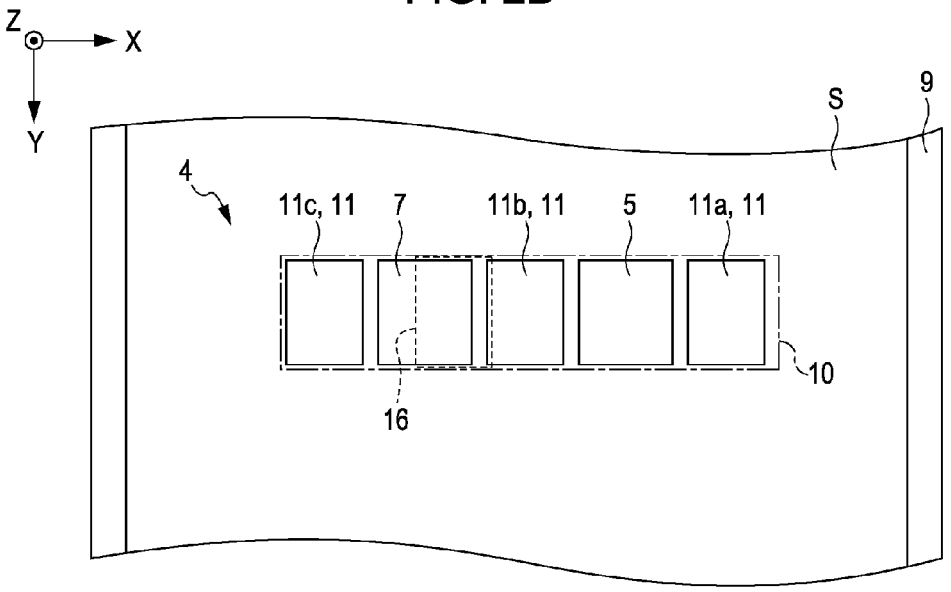

FIGS. 2A and 2B are a front cross-sectional view and a plan view schematically showing the recording section 4 according to the embodiment, respectively. In the figures, FIG. 2A is a front cross-sectional view seen from downstream side to the upstream side in the transporting direction. Meanwhile, FIG. 2B is a plan view of FIG. 2A.

As shown in FIGS. 2A and 2B, the first carriage 10 is disposed at a side (above) from the transparent film S on the medium supporting section 9. Further, the second carriage 18 is disposed at the other side (under the medium supporting section 9).

In addition to the first recording head 5 and the second recording head 7 which are described above, second radiating units 11*a* to 11*c* (11) that can radiate ultraviolet rays W, which is an example of electromagnetic waves W that can cure ink, are disposed at the first carriage 10. A total of three second radiating units 11 are disposed, one between the first recording head 5 and the second recording head 7 and two are both sides outside the first recording head 5 and the second recording head 7. Further, the radiating units are implemented to integrally move in the width direction X.

Further, as described above, the first radiating unit 16 disposed at the second carriage 18 moves in the width direction X in the same way.

The first recording head 5 is equipped with a first nozzle 6 that discharges first type of ink L1 onto the transparent film S. In the embodiment, ink L1, such as cyan, magenta, yellow, and black, is discharged. Meanwhile, the second recording head 7 is equipped with a second nozzle 8 that discharges second type of ink L2. White ink L2 is discharged in the embodiment.

The "first type of ink" is ink that mainly creates information on an image (character, figure, and shape). The first type of ink is the ink discharged to a position above the layer of the second type of ink L2, with an observer at the upper side, when being used with the second type of ink L2. In detail, the first type of ink is chromatic ink or achromatic ink except for white. For example, cyan, magenta, yellow, and black ink may be used. Further, the "second type of ink" is ink used for the base of white and metal colors. It is possible to contribute to expressing the color of the "first type of ink" discharged onto the base by using the "second type of ink" for the base.

Obviously, it is possible to independently use only the "first type of ink".

Further, the printer 1 according to the embodiment has a first recording mode and a second recording mode. The first recording mode in the modes is a mode that performs recording by discharging the second type of ink L2 first and then discharging the first type of ink L1 onto the second type of ink. The first recording mode is a recording mode that is used when the recording target medium S is paper or the like and characters, shapes, pictures or the like are seen from the recorded surface (the surface of the side with the ink discharged).

The second recording mode is a mode that performs recording by discharging the first type of ink L1 first and then discharging the second type of ink L2 onto the first type of ink. The second recording mode is a recording mode that is used when the recording target medium S is a transparent film or the like and characters, shapes, pictures or the like are seen from the surface of the side opposite to the recorded surface (the surface with the ink discharged).

Further, although the position of the first radiating unit 16 in the transporting direction Y is the same as the positions of the first recording head 5 and the second recording head 7 in the embodiment, it is not limited thereto. The first radiating unit 16 may be at the same position or at a further downstream side than the first recording head 5 and the second recording head 7 in the transporting direction. According to these conditions, it is possible to cure the ink landed on the transparent film S by radiating ultraviolet rays W onto the ink.

Next, the relationship between the operation of the first carriage 10 and the second carriage 18 will be described.

Figure 3A:
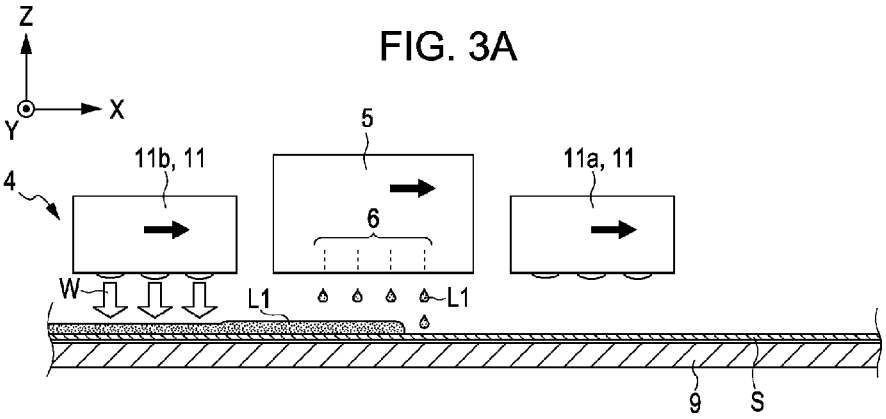
FIGS. 3A to 3C are front cross-sectional views showing the operation of the recording section according to the embodiment.
Figure 3B:
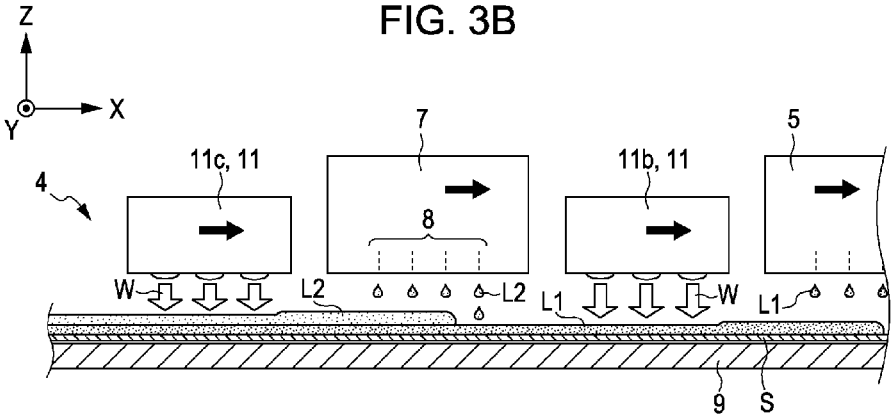
Figure 3C:
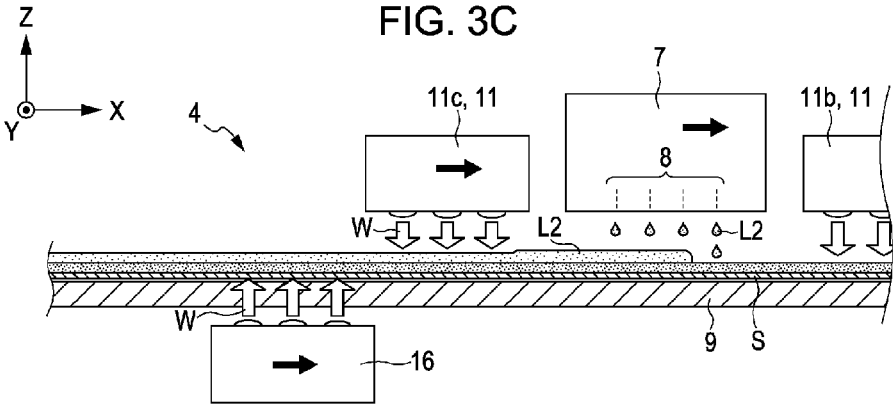
Figure 4:
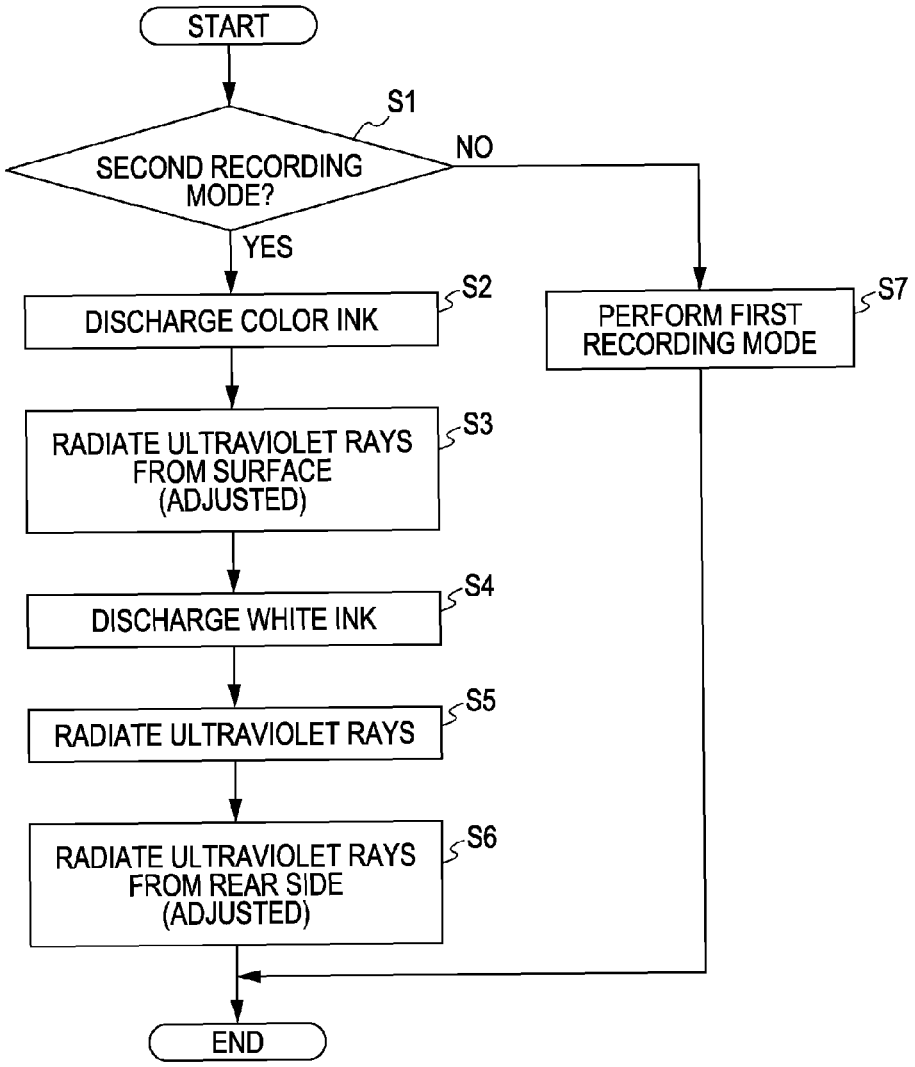
FIG. 4 is a view showing control of the recording section according to the embodiment.

FIGS. 3A to 3C are front cross-sectional views schematically showing the operation of the recording section 4 according to the embodiment. Further, FIG. 4 is a view showing the control of the recording section 4 according to the embodiment. FIGS. 3A to 3C are described while FIG. 4 is described. Further, the first carriage 10 is not shown to make understanding of FIGS. 3A to 3C easy.

As shown in FIG. 4, in step S1, the control section 20 determines whether the recording mode that is currently selected is the second recording mode. When it is determined that the second recording mode has been selected, the second recording mode is performed and the process proceeds to step S2. On the other hand, when it is determined that the second recording mode has not been selected, the first recording mode is performed and the process proceeds to step S7.

In step S2, as shown in FIG. 3A, the ink L1 of cyan, magenta, yellow, and black is discharged as the first type of ink L1 from the first nozzle 6 of the first recording head 5 onto the transparent film S while the first carriage 10 moves. Next, the process proceeds to step S3.

In step S3, ultraviolet rays W are radiated by the second radiating unit 11*b* (11) behind the first recording head 5 in the movement direction such that the ink L1 of cyan, magenta, yellow, and black which is landed on the transparent film S is temporarily cured.

The temporary curing implies a state in which the ink is incompletely cured before being completely cured (complete curing). This is because it is possible to improve fixation of the ink at the upper portion when ink is discharged with semi-drying repeated, as compared with when the surface of the landed ink is completely cured and completely dried.

Further, the radiation amount of the ultraviolet rays W depends on the amount of landed ink per unit area and may be adjusted. In detail, the radiation amount is large when the landed amount is large, while the radiation amount is small when the landed amount is small. The control section 20 can determine whether the landed amount is large or small, from the amount of ink discharged to the corresponding positions on the basis of recording data.

Next, the process proceeds to step S4.

In step S4, as shown in FIG. 3B, white ink L2 as the second type of ink L2 is discharged from the second nozzle 8 of the second recording head 7. Next, the process proceeds to step S5.

In step S5, ultraviolet rays W are radiated from the second radiating unit 11*c* (11) behind the second recording head 7 in the movement direction such that the white ink L2 is cured. Next, the process proceeds to step S6.

In step S6, as shown in FIG. 3C, ultraviolet rays W are radiated by the first radiating unit 16 and the temporarily cured cyan, magenta, yellow, and black are completely cured while the second carriage 18 is moved at a constant speed. In this operation, similar to step S3 described above, the radiation amount of the ultraviolet rays W depends on the amount of landed ink per unit area and may be adjusted. In detail, the radiation amount is large when the landed amount is large, while the radiation amount is small when the landed amount is small. The control section 20 can determine whether the landed amount is large or small, from the amount of ink discharged to the corresponding positions on the basis of recording data.

As a result, it is possible to equally cure the ink at the position where the amount of landed ink per unit is large and small, such that non-uniform curing is not caused.

Further, energy is also saved because it is possible to prevent an unnecessarily large amount of ultraviolet rays W from being radiated to the position where the amount of landed ink per unit area is small.

Further, it is possible to prevent an increase in the amount of contraction of the ink, which is an example of a defect due to radiation of an unnecessarily large amount of ultraviolet rays W.

Further, although the radiation amount to ink per unit area is made substantially the same by adjusting the radiation amount in accordance with the amount of landed ink per unit area while the first radiating unit 16 is moved at a constant speed, but this configuration is not limited. It may be possible to adjust the relative speed to the transparent film S of the first radiating unit 16 without adjusting the radiation amount. In this case, the first radiating unit 16 passes the positions where the amount of landed ink per unit area is large at a low speed. On the other hand, the first radiating unit 16 passes position with a smaller amount of ink than position with a large amount of ink, at a higher speed than that when passing position with a large amount of ink. Therefore, it is possible to make the radiation amount substantially the same for the ink per unit area.

Further, the radiation amount for the ink per unit area may be adjusted in accordance with the types of ink. For example, the black component of black ink absorbs light and radiated light is absorbed at a position close to the surface of ink droplets, such that the inside far from the surface tends to be difficult to cure. Further, since white ink using titanium oxide or metallic color-based ink using aluminum uses metal, light, such as the radiated ultraviolet rays W, is reflected from positions close to the surface of ink droplets, such that the inside far from the surface tends to be difficult to cure. Uniform curing without curing non-uniformity can be achieved by adjusting the radiation amount in accordance with the types of ink in consideration of this tendency.

In step S7, the first recording mode described above is performed. The detailed description is not provided herein. Thereafter, the sequence is finished.

Next, the technical idea of disposing the first radiating unit 16 will be described in detail.

Figure 5A:
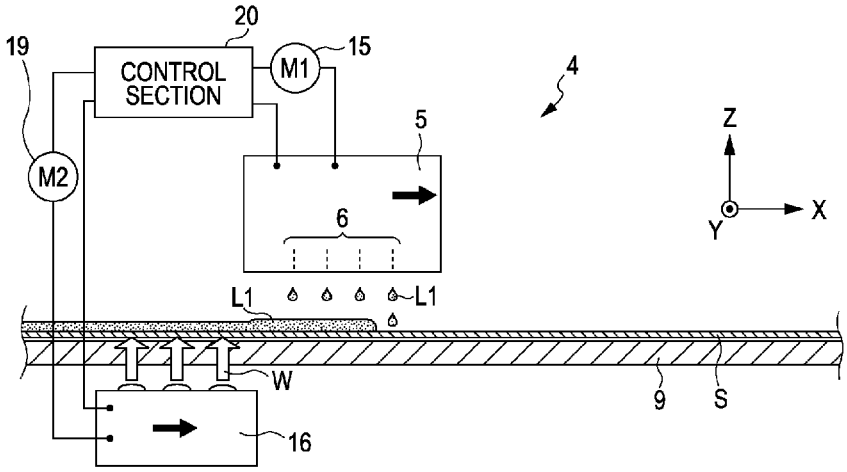
FIGS. 5A and 5B are front cross-sectional views showing the conception of the embodiment.
Figure 5B:
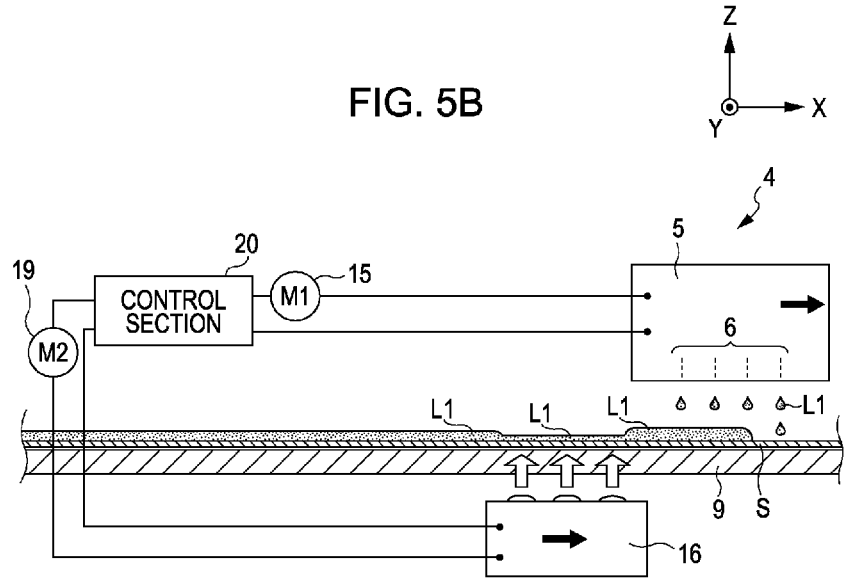

FIGS. 5A to 5C are front cross-sectional views schematically showing the conception of the embodiment. Minimal essential components are described for ease of understanding.

As shown in FIG. 5A, the first recording head 5 and the recording target medium S having the transparency move relatively. The first recording head 5 is moved by the first carriage moving unit 15 in the embodiment.

The ink L1 is discharged from the first nozzle 6 while the first recording head 5 moves. As the first recording head 5 moves, the position with the ink L1 landed and the position of the first nozzle 6 that are opposite to each other come not to be opposite to each other. The first radiating unit 16 cures the landed ink L1 by radiating electromagnetic waves W, at the non-opposite positions with the ink L1 landed.

Since the electromagnetic waves W are not radiated to the first nozzle 6, the ink L1 is not cured at the first nozzle 6 by the electromagnetic waves W. Further, the first nozzle 6 is not correspondingly clogged.

Further, since the first radiating unit 16 is disposed at the opposite side to the side where the first recording head 5 is disposed, with respect to the recording target medium S, the first radiating unit 16 is not stained by the ink droplets or ink mist. In other words, the recording target medium S between the first recording head 5 and the first radiating unit 16 functions as a barrier, such that the first radiating unit 16 is not stained by the ink L1. Further, accordingly, the radiation amount of the first radiating unit 16 is not decreased.

Further, since the first radiating unit 16 is disposed at the opposite side to the first recording head 5, the first radiating unit 16 does not hit against the first recording head 5. Therefore, it is possible to rapidly face the position with the ink L1 landed, as compared with when a radiating unit is disposed only at the same side as a recording head (configuration of the related art). Accordingly, it is possible to cure the ink L1 by rapidly radiating electromagnetic waves W onto the ink L1.

As a result, it is possible to reduce the time from discharging for curing of the ink L1, such that it is possible to reduce an increase in dot diameter of the landed ink L1. It is possible to reduce non-uniformity of the dot diameters because it is possible to reduce the difference between ink of which the dot diameter easily increase and ink of which the dot diameter does not easily increase after the landing.

Further, as the time from discharging for curing of the ink L1 is reduced, it is possible to reduce an influence, such as an abnormal odor, generated during the time.

Further, the control section 20 performs control for changing the radiation amount of the first radiating unit 16 on the basis of the recording data, in accordance with the amount of landed ink L2 per unit area at the position to be irradiated in the recording data. The amount of landed ink L1 can be determined from the amount of discharged ink L1. As the first radiating unit 16 and the recording target medium S move such that the relative positional relationship is changed, the position where the first radiating unit 16 irradiates the recording target medium S is moved. With the movement, the control section 20 controls the radiation amount to be increased when the landed amount is increased, by decreasing the radiation amount when the landed amount is decreased.

As a result, as described above, it is possible to equally cure the ink L1 at the position where the amount of landed ink L1 per unit area is large and small, such that curing non-uniformity is not caused.

Further, energy is also saved because it is possible to prevent an unnecessarily large amount of electromagnetic waves W from being radiated to the position where the amount of landed ink L1 per unit area is small.

Further, it is possible to prevent an increase in the amount of contraction of the ink L1, which is an example of a defect due to radiation of an unnecessarily large amount of electromagnetic waves.

Further, as described above, it may be possible to adjust the relative speed to the recording target medium S of the first radiating unit 16 without adjusting the radiation amount. In this case, since the first radiating unit 16 passes position with a large amount of landed ink L1 per unit area at a low speed, while the first radiating unit 16 passes position with a smaller amount of ink than position with a large amount of ink, at a higher speed than that when passing position with a large amount of ink, it is possible to make the radiation amount for the ink L1 per unit area substantially the same.

Further, as described above, the radiation amount for the ink L1 per unit area may be adjusted in accordance with the type of the ink L1.

Further, although the medium supporting section 9 supports the recording target medium S in the embodiment, the medium supporting section 9 may be removed. For example, the recording target medium S may be transported, with the recording target medium S pinched between a roll and another roll.

Further, although when the color ink L1 is discharged from the first recording head 5 and the color ink L1 is cured by the first radiating unit 16 is described, this configuration is not limited to the color ink L1. White ink L2 may be discharged from the second recording head 7 and cured by the first radiating unit 16.

The printer 1 that is a recording apparatus according to the embodiment includes: the first recording head 5 that is a recording head that performs recording by discharging the ink L1 from the first nozzle 6, which is a nozzle, onto the recording target medium S; the first carriage moving unit 15 that is a first moving unit changing the relative positional relationship between the recording target medium S and the first recording head 5 by moving at least one of the recording target medium S and the first recording head 5; the first radiating unit 16 that is disposed at the opposite side to the first recording head 5 with respect to the recording target medium S and can radiate ultraviolet rays W, which is an example of electromagnetic waves W that cure the ink L1; and the second carriage moving unit 19 that is a second moving unit changing the relative positional relationship between the recording target medium S and the first radiating unit 16 by moving at least one of the recording target medium S and the first radiating unit 16, in which the relationship between the ink L1 and the ultraviolet rays W is the relationship in which the ink L1 is cured by a chemical reaction generated in the ink L1 by radiating the ultraviolet rays W, the recording target medium S has transparency for transmitting the ultraviolet rays W, the position where the ink L1 is discharged from the nozzle of the first recording head 5 and landed on the recording target medium S and the nozzle of the first recording head 5, which are opposite to each other, come not to be opposite to each other, as the first recording head 5 and the recording target medium S are relatively moved by the first carriage moving unit 15, and the first radiating unit 16 irradiates position with the ink L1 landed, on the non-opposite recording target medium S.

Further, in the embodiment, when the first radiating unit 16 irradiates, the first radiating unit 16 and the recording target medium S relatively move, the radiation amount of the first radiating unit 16 is changed in accordance with the amount of landed ink L1 per unit area at the position to be irradiated in the recording data, and as the first radiating unit 16 and the recording target medium S relatively move, the radiation amount is decreased when the landed amount is decreased, while the radiation amount is increased when the landed amount is increased.

Further, since the relative speed of the first radiating unit 16 and the recording target medium S changes in accordance with the amount of landed ink L1 per unit area at the position to be irradiated in the recording data, as the first radiating unit 16 and the recording target medium S relatively move, the relative speed is increased when the landed amount is decreased, while the relative speed is decreased when the landed amount is increased.

Further, the embodiment is further provided with a second radiating unit 11 that is disposed at the same side as the first recording head 5 with respect to the recording target medium S and can radiate ultraviolet rays W that cure the ink L1, and the first radiating unit 16 irradiates a position with the ink L1 landed on the recording target medium S after the second radiating unit 11 irradiates a position with the ink L1 landed on the recording target medium S.

Further, in the embodiment, the recording head includes the first recording head 5 having the first nozzle 6 that discharges the first type of ink L1 to record an image on the recording target medium S and the second recording head 7 having the second nozzle 8 that discharges the second type of ink L2 for a base, and the second recording mode that is a recording mode in which the first type of ink L1 is discharged onto the transparent film S, which is a transparent recording target medium, by the first nozzle 6, the second radiating unit 11*b* (11) irradiates the position with the first type of ink L1 landed on the transparent film S, the second type of ink L2 is discharged by the second nozzle 8 onto the transparent film S with the first type of ink L1 landed, the second radiating unit 11*c* (11) irradiates the position with the second type of ink L2 landed on the transparent film S, and the first radiating unit 16 irradiates the position with the first type of ink L1 landed on the transparent film S.

Further, in the embodiment, the amount of ultraviolet rays W radiated by the first radiating unit 16 changes in accordance with the type of the ink L1 and L2.

Other Embodiments

Figure 6:
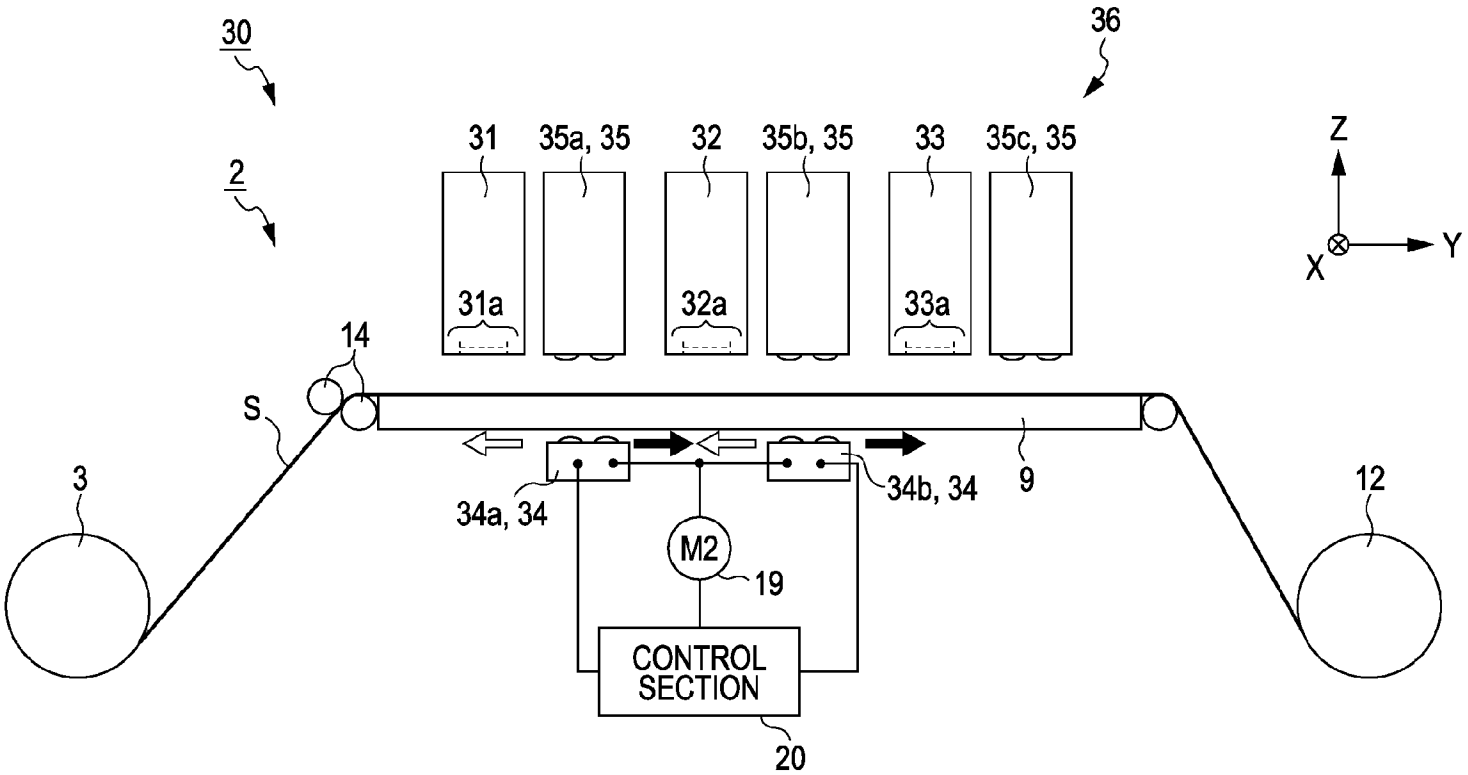
FIG. 6 is a side view schematically showing a line printer according to another embodiment.
Figure 7:
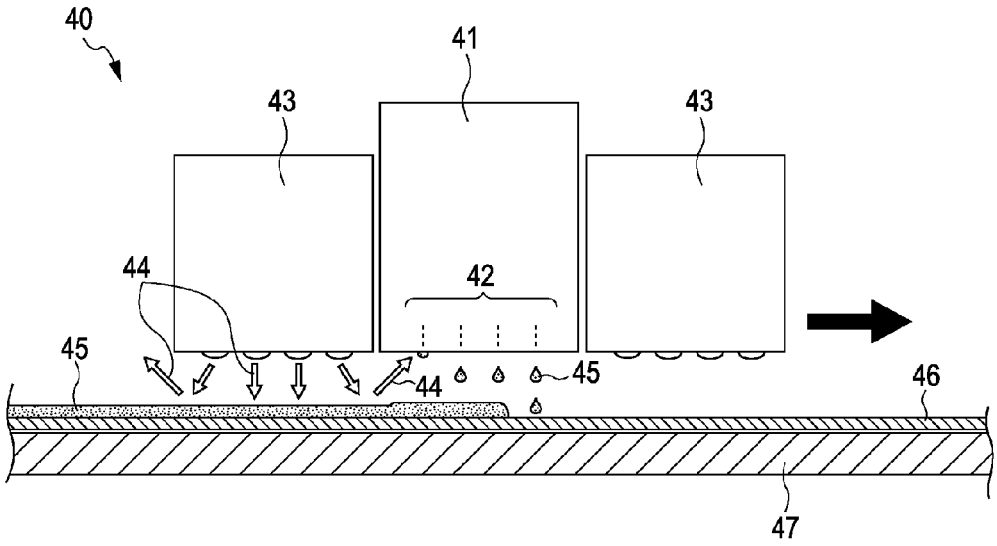
FIG. 7 is a front cross-sectional view showing the relationship between a recording head and an ultraviolet radiating section of the related art.

FIG. 6 is a side view schematically showing a line printer 30 that is another embodiment.

As shown in FIG. 6, a recording section 36 according to another embodiment includes a first recording head 31, a second recording head 32, and a third recording head 33, sequentially from the upstream side to the downstream side in the transporting direction. The first recording head 31 to the third recording head 33 are long in the width direction X of a recording target medium S and can discharge ink L1 and L2 from each of nozzles 31*a* to 33*a* to a range larger than the width of the recording target medium S. In those components, the first recording head 31 discharges white ink L2 from the nozzle 31*a*. Further, the second recording head 32 discharges ink L1 of cyan, magenta, yellow, and black from the nozzle 32*a*. Further, the third recording head 33 discharges white ink L2 from the nozzle 33*a*.

Further, for example, two of first radiating units 34*a* and 34*b* (34) that can radiate ultraviolet rays W that cure the ink L1 and L2 are disposed at the opposite side to the side where the first recording head 31 to the third recording head 33 are disposed with respect to the recording target medium S. Two first radiating units 34*a* and 34*b* (34) are disposed to be movable by a second carriage moving unit 19, as in the embodiment described above.

Further, the difference from the embodiment described above is that they can move in the width direction X in the embodiment described above, while they can move in the transporting direction Y in this embodiment. This is because the first radiating unit 34 is long in the width direction X, similar to the first recording head 31 to the third recording head 33 and can radiate ultraviolet rays W to a range where the first recording head 31 to the third recording head 33 can discharge ink and which is larger than the width of the recording target medium S, such that they are not necessary to move in the width direction X. Further, this is for changing the positions in accordance with recording modes, which are described below. Further, this is also for adjusting the radiation amount per unit amount of the ink L1 and L2, if necessary. As the technical idea, it may be possible to radiate ultraviolet rays W onto the position with the ink L1 and L2 landed on the recording target medium S while moving at least one of the recording target medium S and the first radiating unit 34 to change the relative positional relationship between the recording target medium S and the first radiating unit 34. Therefore, the recording target medium S may move with respect to the first radiating unit 34 while the first radiating unit 34 may not move.

Meanwhile, three second radiating units 35*a* to 35*c* (35) that can radiate ultraviolet rays W that cure the ink L1 and L2 are disposed at the side where the first recording head 31 to the third recording head 33 are disposed. The three second radiating units 35*a* to 35*c* (35) are disposed at the downstream sides of the first recording head 31 to the third recording head 33 in the transporting direction. The three second radiating units 35*a* to 35*c* (35) radiate ultraviolet rays W to the positions where the ink L1 and L2 discharged from the recording heads 31 to 33 at the upstream sides is landed.

This configuration is the same as that of the embodiment described above, such that like reference numerals are provided and the description is not provided.

In the first recording mode described above, white ink L2 is discharged to the recording target medium S from the first recording head 31 and ultraviolet rays W are radiated from at least one of the first radiating unit 34*a* (34) and the second radiating unit 35*a* (35), such that the white ink L2 is temporarily cured. Thereafter, ink L1 of cyan, magenta, yellow, and black is discharged from the second recording head 32 and ultraviolet rays W are radiated by the first radiating unit 34*b* (34) and the second radiating unit 35*b* (35), such that the white ink L2 and the ink L1 of cyan, magenta, yellow, and black are completely cured.

On the other hand, in the second recording mode described above, ink L1 of cyan, magenta, yellow, and black is discharged onto the transparent film S from the second recording head 32 and ultraviolet rays W are radiated by at least one of the first radiating unit 34*a* (34) and the second radiating unit 35*b* (35), such that the ink L1 of cyan, magenta, yellow, and black is temporarily cured. Thereafter, white ink L2 is discharged from the third recording head 33. Thereafter, the white ink L2 is cured by radiating ultraviolet rays W thereon from the second radiating unit 35*c* (35). Similarly, the ink L1 of cyan, magenta, yellow, and black is cured by radiating ultraviolet rays W onto the ink L1 from the first radiating unit 34*b* (34).

In this process, similar to the embodiment described above, since the first radiating unit 34 radiates the ultraviolet rays W from the opposite side to the recording heads 31 to 33, it is possible to achieve the same operational effect as the embodiment described above.

Further, although two first radiating units 34 are disposed, the number is not limited to two. One may be possible and three may be possible. The reason that two first radiating units are disposed in this embodiment is because curing is achieved without curing non-uniformity by moving the positions in accordance with the recording modes and radiating an appropriate amount of ultraviolet rays W from both front and back sides.

It is the same as those in the embodiment described above to adjust the radiation amount in accordance with the amount of landed ink L1 and L2 per unit area and adjust the radiation amount in accordance with the types of the ink L1 and L2. The description is not provided.

The line printer 30 that is a recording apparatus according to this embodiment includes: the second recording head 32 that is a recording head that performs recording by discharging the ink L1 from the nozzle 32*a* onto the recording target medium S; the medium transporting unit 2 that is a first moving unit changing the relative positional relationship between the recording target medium S and the second recording head 32 by moving at least one of the recording target medium S and the second recording head 32; the first radiating unit 34 that is disposed at the opposite side to the second recording head 32 with respect to the recording target medium S and can radiate ultraviolet rays W, which is an example of electromagnetic waves W that cure the ink L1; and the medium transporting unit 2 that is the second moving unit changing the relative positional relationship between the recording target medium S and the first radiating unit 34 by moving at least one of the recording target medium S and the first radiating unit 34, in which the relationship between the ink L1 and the ultraviolet rays W is the relationship in which the ink L1 is cured by a chemical reaction generated in the ink L1 by radiating the ultraviolet rays W, the recording target medium S has transparency for transmitting the ultraviolet rays W, the position where the ink L1 is discharged from the nozzle 32*a* of the second recording head 32 and landed on the recording target medium S and the nozzle 32*a* of the second recording head 32, which are opposite to each other, come not to be opposite to each other, as the second recording head 32 and the recording target medium S are relatively moved by the medium transporting unit 2, and the first radiating unit 34 irradiates the positions with the ink L1 landed, on the non-opposite recording target medium S.

The invention is not limited to the embodiments described above and may be modified in various ways within the scope described in aspects, and the modifications should be construed as being included in the invention.

What is claimed is:

1. A recording apparatus comprising:

a recording head that discharges ink onto a recording target medium from a nozzle;

a first moving unit that moves the recording head;

a first radiating unit that is disposed at the opposite side to the recording head with respect to the recording target medium and radiates electromagnetic waves that cure the ink; and a second moving unit that moves the first radiating unit, and a control unit that controls driving of the recording head, the first moving unit, the first radiating unit, and the second moving unit, wherein when the nozzle of the recording head is not opposite to the position where the ink discharged from the nozzle of the recording head is landed on the recording target medium, the control unit controls the first radiating unit to radiate electromagnetic waves to the position where the ink is landed, wherein when the first radiating unit radiates the electromagnetic waves, the control unit moves the first radiating unit disposed at the opposite side of the recording target medium relative to the recording target medium by using the second moving unit, wherein a radiation amount of electromagnetic waves radiated from the first radiating unit changes in accordance with an amount of landed ink per unit area at positions where the electromagnetic waves are radiated, wherein the control unit controls the first moving unit and the second moving unit to move both the first recording head and the first radiating unit relative to the recording target medium at the same time when discharging ink from the recording head and curing the ink landed on the recording target medium with the first radiating unit.

2. The recording apparatus according to claim 1, wherein the control unit decreases the radiation amount when the landed amount is relatively decreased as the first radiating unit and the recording target medium relatively move, and increases the radiation amount when the landed amount is relatively increased.

3. The recording apparatus according to claim 1, wherein a relatively moving speed between the first radiating unit and the recording target medium is changed in accordance with the amount of landed ink per unit area at the positions where the electromagnetic waves are radiated, onto the recorded data.

4. The recording apparatus according to claim 3, wherein the second moving unit increases the relatively moving speed when the landed amount is relatively decreased as the first radiating unit and the recording target medium relatively move, and decreases the relatively moving speed when the landed amount is relatively increased.

5. The recording apparatus according to claim 1, further comprising:

a second radiating unit that is disposed at the same side as the recording head with respect to the recording target medium, radiates electromagnetic waves that cure the ink, and is controlled to be driven by the control unit, wherein the control unit controls the first radiating unit to radiate the electromagnetic waves to the position with the ink landed on the recording target medium after the second radiating unit radiates the electromagnetic waves to the position with the ink landed on the recording target medium.

6. The recording apparatus according to claim 5, wherein the recording head includes:

a first nozzle that discharges a first type of ink to record an image on the recording target medium; and a second nozzle that discharges a second type of ink for a base, and wherein the control unit controls the first nozzle to discharge the first type of ink onto the recording target medium, controls the second radiating unit to radiate the electromagnetic waves to the position with the first type of ink landed on the recording target medium, controls the second nozzle to discharge the second type of ink to the position with the first type of ink landed on the recording target medium, controls the second radiating unit to radiate the electromagnetic waves to the position with the second type of ink landed on the recording target medium, and controls the first radiating unit to radiate the electromagnetic waves to the position with the first type of ink landed on the recording target medium.

7. The recording apparatus according to claim 5, wherein the recording head includes a first nozzle that discharges a first type of ink for recording an image on a the recording target medium and a second nozzle that discharges a second type of ink for a base, and the control unit controls the second recording head to discharge the second type of ink onto the recording target medium, controls the second radiating unit to radiate the electromagnetic waves to the position with the second type of ink landed on the recording target medium, controls the first nozzle to discharge the first type of ink to the position with the second type of ink landed on the recording target medium, controls the second radiating unit to radiate the electromagnetic waves to the position with the first type of ink landed on the recording target medium, and controls the first radiating unit to radiate the electromagnetic waves to the position with the second type of ink landed on the recording target medium.

8. The recording apparatus according to claim 1, further comprising:

a second radiating unit that is disposed at the same side as the recording head with respect to the recording target medium, radiates electromagnetic waves that cure the ink, and is controlled to be driven by the control unit, wherein the control unit controls the second radiating unit to radiate the electromagnetic waves to the position with the ink landed on the recording target medium after the first radiating unit radiates the electromagnetic waves to the position with the ink landed on the recording target medium.

9. The recording apparatus according to claim 8, wherein the recording head includes a first nozzle that discharges a first type of ink for recording an image on a the recording target medium and a second nozzle that discharges a second type of ink for a base, and the control unit controls the first nozzle to discharge the first type of ink onto the recording target medium, controls the first radiating unit to radiate the electromagnetic waves to the position with the first type of ink landed on the recording target medium, controls the second nozzle to discharge the second type of ink to the position with the first type of ink landed on the recording target medium, controls the second radiating unit to radiate the electromagnetic waves to the position with the second type of ink landed on the recording target medium, and controls the first radiating unit to radiate the electromagnetic waves to the position with the first type of ink landed on the recording target medium.

10. The recording apparatus according to claim 8, wherein the recording head includes a first nozzle that discharges a first type of ink for recording an image on a the recording target medium and a second nozzle that discharges a second type of ink for a base, and the control unit controls the second nozzle to discharge the second type of ink onto the recording target medium, controls the first radiating unit to radiate the electromagnetic waves to the position with the second type of ink landed on the recording target medium, controls the first nozzle to discharge the first type of ink to the position with the second type of ink landed on the recording target medium, controls the second radiating unit to radiate the electromagnetic waves to the position with the first type of ink landed on the recording target medium, and controls the first radiating unit to radiate the electromagnetic waves to the position with the second type of ink landed on the recording target medium.

11. The recording apparatus according to claim 1, further comprising:

a second radiating unit that is disposed at the same side as the recording head with respect to the recording target medium, radiates electromagnetic waves that cure the ink, and is controlled to be driven by the control unit, wherein the control unit controls the first radiating unit and the second radiating unit to radiate the electromagnetic waves to the position with the ink landed on the recording target medium such that at least radiation timings are partially overlapped.

12. The recording apparatus according to claim 11, wherein the recording head includes a first nozzle that discharges a first type of ink for recording an image on a the recording target medium and a second nozzle that discharges a second type of ink for a base, and the control unit controls the first nozzle to discharge the first type of ink onto the recording target medium, controls the first radiating unit and the second radiating unit to radiate the electromagnetic waves to the position with the first type of ink landed on the recording target medium such that at least the radiation timings are partially overlapped, controls the second nozzle to discharge the second type of ink to the position with the first type of ink landed on the recording target medium, controls the second radiating unit to radiate the electromagnetic waves to the position with the second type of ink landed on the recording target medium, and controls the first radiating unit to radiate the electromagnetic waves to the position with the first type of ink landed on the recording target medium.

13. The recording apparatus according to claim 11, wherein the recording head includes a first nozzle that discharges a first type of ink for recording an image on a the recording target medium and a second nozzle that discharges a second type of ink for a base, and the control unit controls the second nozzle to discharge the second type of ink onto the recording target medium, controls the first radiating unit and the second radiating unit to radiate the electromagnetic waves to the position with the second type of ink landed on the recording target medium such that at least the radiation timings are partially overlapped, controls the first nozzle to discharge the first type of ink to the position with the second type of ink landed on the recording target medium, controls the second radiating unit to radiate the electromagnetic waves to the position with the first type of ink landed on the recording target medium, and controls the first radiating unit to radiate the electromagnetic waves to the position with the second type of ink landed on the recording target medium.

14. The recording apparatus according to claim 1, wherein the control unit changes the amount of electromagnetic waves radiated by the first radiating unit in accordance with types of the ink.

* * * * *